US009026019B2

(12) United States Patent
Suzuki

(10) Patent No.: US 9,026,019 B2
(45) Date of Patent: May 5, 2015

(54) TRANSFER DEVICE, METHOD FOR PERFORMING THE SAME AND IMAGE FORMING DEVICE

(71) Applicant: Katsuhito Suzuki, Kanagawa (JP)

(72) Inventor: Katsuhito Suzuki, Kanagawa (JP)

(73) Assignee: Ricoh Company, Limited, Tokyo (JP), `

( * ) Notice: Subject to any disclaimer, the term of this patent is extended or adjusted under 35 U.S.C. 154(b) by 0 days.

(21) Appl. No.: 14/030,488

(22) Filed: Sep. 18, 2013

(65) Prior Publication Data

US 2014/0079422 A1 Mar. 20, 2014

(30) Foreign Application Priority Data

Sep. 18, 2012 (JP) ..... 2012-204074
May 20, 2013 (JP) ..... 2013-106526

(51) Int. Cl.
*G03G 15/20* (2006.01)
*G03G 15/16* (2006.01)
*G03G 15/01* (2006.01)

(52) U.S. Cl.
CPC ..... *G03G 15/1675* (2013.01); *G03G 15/0194* (2013.01); *G03G 2215/1614* (2013.01); *G03G 15/167* (2013.01); *G03G 15/1665* (2013.01)

(58) Field of Classification Search
CPC ..... G03G 15/1675
USPC ..... 399/314
See application file for complete search history.

(56) References Cited

U.S. PATENT DOCUMENTS 3,860,857 A * 1/1975 Namiki et al. ..... 361/230
8,818,221 B2 * 8/2014 Ogino et al. ..... 399/66
8,891,996 B2 * 11/2014 Fujita et al. ..... 399/88
8,909,079 B2 * 12/2014 Aoki et al. ..... 399/66
2008/0063416 A1 3/2008 Watanabe
2011/0229168 A1 9/2011 Shiraishi et al.
2012/0045231 A1 2/2012 Ogino et al.
2012/0045237 A1 2/2012 Aoki et al.
2012/0045259 A1 2/2012 Nakamura et al.
2012/0213536 A1 8/2012 Takeuchi
2012/0230715 A1 9/2012 Ogino et al.
2012/0237234 A1 9/2012 Sugimoto et al.
2012/0237271 A1 9/2012 Sengoku et al.
2012/0243892 A1 9/2012 Nakamura et al.
2012/0308250 A1 12/2012 Shimizu et al.
2012/0315058 A1 12/2012 Shimizu et al.
2012/0321336 A1 12/2012 Ogiyama
2012/0328314 A1 12/2012 Sugimoto et al.

(Continued)

FOREIGN PATENT DOCUMENTS

JP 58-014225 1/1983
JP 63-078466 4/1988

(Continued)

*Primary Examiner* — David Gray
*Assistant Examiner* — Geoffrey Evans
(74) *Attorney, Agent, or Firm* — Oblon, McClelland, Maier & Neustadt, L.L.P.

(57) ABSTRACT

A transfer device comprising: a load including a transferring unit, the transferring unit being configured to transfer an image on a transferable material; a direct current source connected to the load and configured to apply a direct voltage to the load; and an alternating current source connected between the load and the direct current source in attachable and detachable manner, the alternating current source being configured to selectively apply to the load an overlapping voltage that is formed by overlapping an alternating voltage and the direct voltage.

13 Claims, 12 Drawing Sheets

(56) References Cited

U.S. PATENT DOCUMENTS

| | | | |
|---|---|---|---|
| 2012/0328315 | A1 | 12/2012 | Takeuchi et al. |
| 2012/0328320 | A1 | 12/2012 | Fujita et al. |
| 2012/0328321 | A1 | 12/2012 | Takeuchi et al. |
| 2013/0004190 | A1 | 1/2013 | Sengoku et al. |
| 2013/0011155 | A1 | 1/2013 | Ogiyama et al. |
| 2013/0016989 | A1 | 1/2013 | Fujita et al. |
| 2013/0064559 | A1 | 3/2013 | Nakamura et al. |
| 2013/0078014 | A1 | 3/2013 | Ogiyama |
| 2013/0089363 | A1 | 4/2013 | Mimbu et al. |
| 2013/0094870 | A1 | 4/2013 | Shimizu et al. |
| 2013/0121714 | A1 | 5/2013 | Tanaka et al. |
| 2013/0136468 | A1 | 5/2013 | Shimizu et al. |
| 2013/0136477 | A1 | 5/2013 | Ogiyama et al. |
| 2013/0142531 | A1 | 6/2013 | Sugimoto et al. |
| 2013/0148993 | A1 | 6/2013 | Aoki et al. |
| 2013/0164011 | A1 | 6/2013 | Nakamura et al. |
| 2013/0177329 | A1 | 7/2013 | Tanaka et al. |
| 2013/0195483 | A1 | 8/2013 | Shimizu et al. |
| 2013/0216281 | A1 | 8/2013 | Suzuki et al. |
| 2014/0029988 | A1* | 1/2014 | Shimizu et al. ..... 399/314 |
| 2014/0147182 | A1* | 5/2014 | Sengoku et al. ..... 399/350 |
| 2014/0265552 | A1* | 9/2014 | Maekawa et al. ..... 307/2 |

FOREIGN PATENT DOCUMENTS

| | | |
|---|---|---|
| JP | 2008-065176 | 3/2008 |
| JP | 2011-113850 | 6/2011 |
| JP | 2012-042835 | 3/2012 |

* cited by examiner

| TUB TERMINAL | JIS SERIES (W) | H1 (mm) | H2 (mm) | D (mm) |
|---|---|---|---|---|
| "187" | 4.8mm | 3.2 | 6.35 | o1.30 |
| "205" | – | 3.2 | 6.35 | o1.65 |
| "250" | 6.3mm | 3.4 | 7.95 | o1.65 |

TRANSFER DEVICE, METHOD FOR PERFORMING THE SAME AND IMAGE FORMING DEVICE

CROSS-REFERENCE TO RELATED APPLICATIONS

The present application claims priority to and incorporates by reference the entire contents of Japanese Patent Application No. 2012-204074 filed in Japan on Sep. 18, 2012 and Japanese Patent Application No. 2013-106526 filed in Japan on May 20, 2013.

BACKGROUND OF THE INVENTION

1. Field of the Invention

The present invention relates to transfer devices and image forming devices.

2. Description of the Related Art

In an electrophotographic image forming device, in general, a direct-current voltage is applied from a transfer power supply to an electrostatic toner pattern created on an image carrier to move a developer such as toner constituting the electrostatic toner pattern to paper and transfer the electrostatic toner pattern to the paper.

When print is produced on paper with low surface smoothness having large asperities on the surface thereof such as Leathac paper or Japanese paper, a developer is less prone to be transferred to indentations than protrusions on the surface, which causes a problem that light print is made at the indentations.

Accordingly, there has been suggested a technique for improving the rate of transferring a developer to indentations by superimposing an alternating-current voltage on a direct-current voltage for transfer to vibrate the developer (for example, see Japanese Patent Application Laid-open No. 2012-42835).

However, the foregoing conventional technique is based on the premise that a power supply has an integration of a direct-current power supply and an alternating-current power supply. Thus, it cannot be said that the conventional technique provides an optimum power supply to achieve functionality needed by customers.

For example, no alternating-current power supply is required by customers who do not need printing on paper with low surface smoothness. In this case, the foregoing conventional technique provides an overengineered power supply.

As a measure, power supplies without an alternating-current power supply may be prepared (developed) for customers who do not need printing on paper with low surface smoothness. However, this measure leads to increase in man-hour for the development and management cost. In addition, even if users do not initially need printing on paper with low surface smoothness, they may afterward need printing on paper with low surface smoothness.

The present invention is devised in light of the foregoing circumstances. There is a need to provide a transfer device and an image forming device that offer an optimum power supply to achieve functionality needed by customers.

SUMMARY OF THE INVENTION

It is an object of the present invention to at least partially solve the problems in the conventional technology.

According to an aspect of the invention, a transfer device is provided. A transfer device includes: a load including a transferring unit, the transferring unit being configured to transfer an image on a transferable material; a direct current source connected to the load and configured to apply a direct voltage to the load; and an alternating current source connected between the load and the direct current source in attachable and detachable manner, the alternating current source being configured to selectively apply to the load an overlapping voltage that is formed by overlapping an alternating voltage and the direct voltage.

According to another aspect of the invention, a method for performing the transfer device set forth in claim 1 is provided. The method includes: by the transferring unit, transferring the image on the transferable material; by the direct current source, applying the direct voltage to the load; and by the alternating current source, selectively applying to the load the overlapping voltage that is formed by overlapping the alternating voltage and the direct voltage.

According to further aspect of the invention, an image forming device including the transfer device set forth in claim 1 is provided.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of a transfer device and an image forming device according to the present invention will be described below in detail with reference to the attached drawings. In the following embodiments, the image forming device of the present invention is applied to an electrophotographic monochrome copying machine, but the image forming device of the present invention is not limited to this. The image forming device of the present invention can be applied to both monochrome and color electrophotographic image forming devices, for example, electrophotographic printing devices, MFPs (multifunction peripherals), and the like. The MFPs here refers to devices with at least two of printing function, copying function, scanning function, and facsimile function.

First, a configuration of a copying system of the embodiment will be described.

Figure 1:
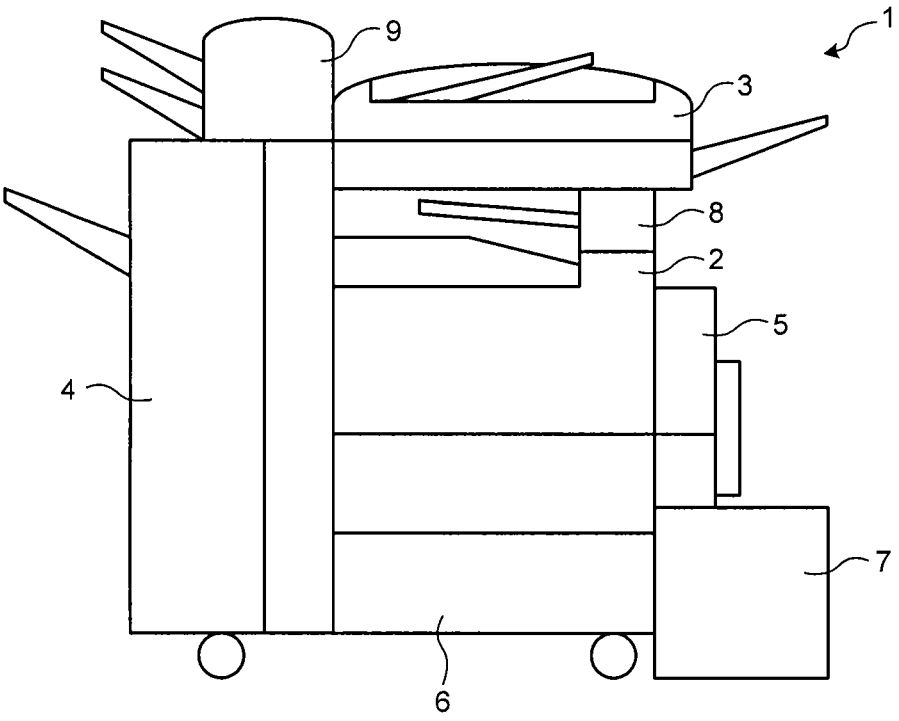
FIG. 1 is a schematic view of one example of an entire configuration of a copying system of an embodiment.

FIG. 1 is a schematic view of one example of an entire configuration of a copying system 1 of the embodiment. As illustrated in FIG. 1, the copying system 1 includes a copying machine 2, an ADF (auto document feeder) 3, a finisher 4, a duplex reversing unit 5, an extensible paper feeding tray 6, a large-capacity paper feeding tray 7, an insert feeder 8, and a one-bin discharge tray 9.

The copying machine 2 corresponds to a main body portion of the copying system 1. The copying machine 2 includes a scanning unit that reads electronically a document and generates image data; an image forming unit that forms an image on the basis of the image data generated by the scanning unit; a paper feeding unit that feeds paper; a transfer unit that transfers the formed image to the paper, and the like (the scanning unit and the paper feeding unit are not illustrated in any of the drawings, and the image forming unit and the transfer unit are not illustrated in FIG. 1). In the following description, the paper with an image transferred may be called a copy.

The ADF 3 is configured to automatically send a document to the copying machine 2 (specifically, the scanning unit of the copying machine 2).

The finisher 4 is a so-called post-processing device having a stapler, a shift tray, and the like, which performs post-processing such as a stapling process on a copy produced by the copying machine 2. The finisher 4 is not limited to this but may be any finisher performing post-processing such as a stapling process, a punching (perforating) process, a folding process, and the like.

The duplex reversing unit 5 is intended to, when paper is to be copied on both sides, reverse the paper with an image transferred to a single side and return the same to the copying machine 2 (specifically, the transfer unit of the copying machine 2).

The extensible paper feeding tray 6 is an extensible paper feeding tray that feeds paper to the transfer unit of the copying machine 2.

The large-capacity paper feeding tray 7 is a paper feeding tray that is capable of storing a larger volume of paper than the paper feeding unit and the extensible paper feeding tray 6 of the copying machine 2 and feeds the paper to the transfer unit of the copying machine 2.

The insert feeder 8 feeds paper such as cover sheets and insert paper to the transfer unit of the copying machine 2.

The one-bin discharge tray 9 is a discharge tray with one bin as a discharge destination. Copies produced by the copying machine 2 are discharged into the one-bin discharge tray 9.

Figure 2:
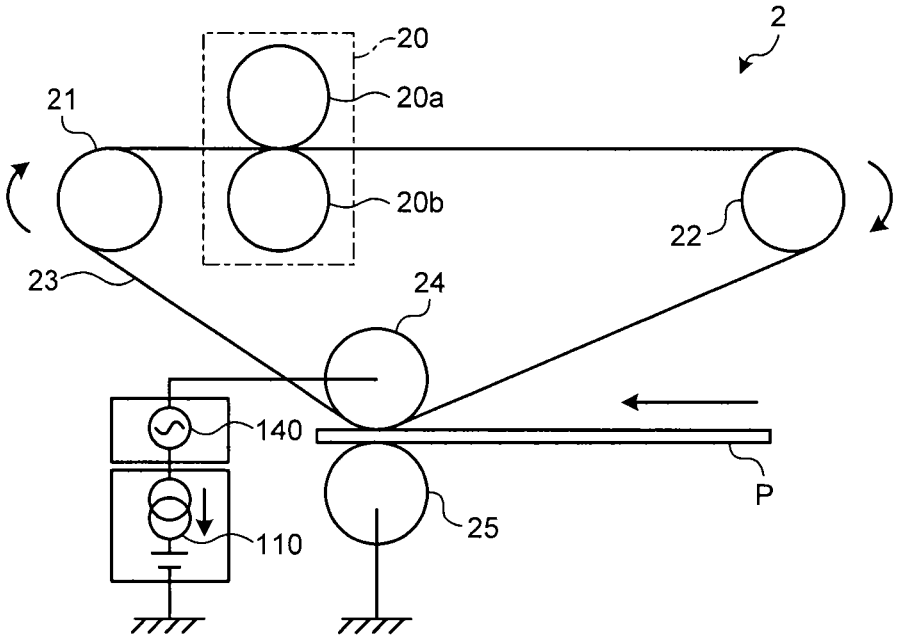
FIG. 2 is a schematic view of one example of a configuration of a copying machine of the embodiment related to image formation and transfer.

FIG. 2 is a schematic view of one example of a configuration of the copying machine 2 of the embodiment relating to image formation and transfer. As illustrated in FIG. 2, the copying machine 2 includes an image forming unit 20, driving rollers 21 and 22, an intermediate transfer belt 23, a repulsive roller 24, a secondary transfer roller 25, a direct-current power supply 110 and an alternating-current power supply 140 for secondary transfer. The alternating-current power supply 140 is detachable from the copying machine 2.

The image forming unit 20 includes a photosensitive drum 20*a*, a charging device, a developing device, a primary transfer roller 20*b*, and a cleaning device, and the like (the charging device, the developing device, and the cleaning device are not illustrated).

The image forming unit 20 and an radiating device not illustrated perform an image forming process (charging step, radiating step, developing step, transferring step, and cleaning step) on the photosensitive drum 20*a* to form an electrostatic toner pattern on the photosensitive drum 20*a* and transfer the same to the intermediate transfer belt 23.

First, at the charging step, the charging device not illustrated charges electrically the surface of the rotated and driven photosensitive drum 20*a*.

Then, at the radiating step, the radiating device not illustrated radiates optically-modulated laser light to the electrically charged surface of the photosensitive drum 20*a* to form an electrostatic latent image on the surface of the photosensitive drum 20*a*.

Next, at the developing step, the developing device not illustrated develops the electrostatic latent image formed on the photosensitive drum 20*a* with toner (one example of a developer). Accordingly, the electrostatic toner pattern as a toner image formed by developing the electrostatic latent image with toner is formed on the photosensitive drum 20*a*.

Subsequently, at the transferring step, the primary transfer roller 20*b* transfers the electrostatic toner pattern formed on the photosensitive drum 20*a* to the intermediate transfer belt 23 (primary transfer). Even after the transfer of the electrostatic toner pattern, a slight amount of non-transferred toner is left on the photosensitive drum 20*a*.

Then, at the cleaning step, the cleaning device not illustrated sweeps away the non-transferred toner left on the photosensitive drum 20*a*.

In the embodiment, since the copying machine 2 is a copying machine producing copies in monochrome, the number of the image forming unit is one. However, when the copying machine 2 is capable of producing copies in colors, the number of the image forming units is two or more according to the number of colors of toner to be used. In this case, the image forming units are different in colors of toner to be used but are identical in configuration and operation.

The intermediate transfer belt 23 is an endless belt that is routed on a plurality of rollers such as the driving rollers 21 and 22 and the repulsive roller 24, and moves in an endless manner when either of the driving rollers 21 and 22 is rotated and driven.

The intermediate transfer belt 23 transfers the electrostatic toner pattern transferred by the image forming unit 20 (primary transfer roller 20*b*) to between the repulsive roller 24 and the secondary transfer roller 25. At that time, the paper feeding unit not illustrated and the like transfer paper P to between the repulsive roller 24 and the secondary transfer roller 25 in a manner timed to the transfer of the electrostatic toner pattern. Accordingly, the electrostatic toner pattern and the paper P are aligned in transfer position.

In the embodiment, the paper P is Leathac paper with low surface smoothness (having large asperities on the surface) or plain paper with high surface smoothness (having small asperities on the surface), for example, but the paper P is not limited to the foregoing.

The repulsive roller 24 (one example of a load) uses a secondary transfer nip (not illustrated) between the repulsive roller 24 and the secondary transfer roller 25 to transfer an electrostatic toner pattern transferred by the intermediate transfer belt 23 to the paper P (secondary transfer). The repulsive roller 24 is connected to the alternating-current power supply 140 as a power supply for transfer bias (however, connected to the direct-current power supply 110 when the alternating-current power supply 140 is not connected to the copying machine 2), and the secondary transfer roller 25 is grounded.

The direct-current power supply 110 and the alternating-current power supply 140 constitute a secondary transfer power supply which applies a high voltage to the repulsive roller 24 in a manner timed to the secondary transfer by the repulsive roller 24 and the secondary transfer roller 25. In this arrangement, since toner in the copying machine 2 is negatively charged as in general image forming devices, the direct-current power supply 110 and the alternating-current power supply 140 apply a negative high voltage to the repulsive roller 24 to add a repulsive force to the toner and perform transfer.

The direct-current power supply 110 outputs a direct-current voltage. The direct-current power supply 110 outputs a direct-current voltage to the alternating-current power supply 140 when the alternating-current power supply 140 is connected, and outputs a direct-current voltage to the repulsive roller 24 when the alternating-current power supply 140 is not connected. The alternating-current power supply 140 is attachable and detachable in series between the direct-current power supply 110 and the repulsive roller 24. The alternating-current power supply 140 outputs selectively the superimposed voltage formed by superimposing an alternating-current voltage on the direct-current voltage output from the direct-current power supply 110 and the direct-current voltage output from the direct-current power supply 110, to the repulsive roller 24.

Specifically, the alternating-current power supply 140 applies the superimposed voltage to the repulsive roller 24 or applies the direct-current voltage to the repulsive roller 24, according to user settings. In the embodiment, it is assumed that user settings are made in advance by a user such that, when the paper P is Leathac paper, the superimposed voltage is applied to the repulsive roller 24, and when the paper P is plain paper, the direct-current voltage is applied to the repulsive roller 24.

Accordingly, a potential difference is made between the repulsive roller 24 and the secondary transfer roller 25 to generate a voltage to move the toner from the intermediate transfer belt 23 toward the paper P, whereby the electrostatic toner pattern can be transferred to the paper P. That is, the repulsive roller 24 uses the voltage (the superimposed voltage or the direct-current voltage) output from the alternating-current power supply 140 to transfer the toner to the paper P.

When the paper P is Leathac paper with low surface smoothness, the toner is moved (vibrated) by the superimposed voltage in two directions (the transfer direction and the opposite direction) to transfer the toner. This improves the rate of transfer of toner to indentations on the paper surface and prevent occurrence of an uneven density and the like, thereby achieving improvement of image quality. Meanwhile, when the paper P is plain paper with high surface smoothness, the toner is moved by the direct-current voltage in the transfer direction to transfer the toner. This suppresses dispersion of the toner and prevents occurrence of image blurs, thereby achieving improvement of image quality.

When the electrostatic toner pattern is transferred to the paper P, the fixing device not illustrated heats and presses the paper P to fix the electrostatic toner pattern to the paper P. Then, the paper P with the fixed electrostatic toner pattern is discharged from the copying machine 2 into the one-bin discharge tray 9 (see FIG. 1).

Figure 3:
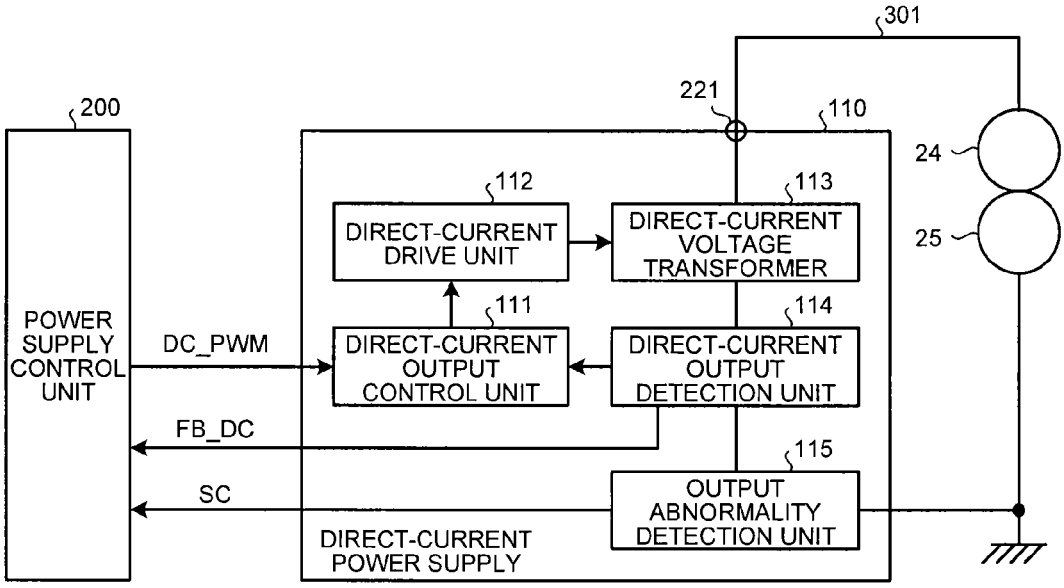
FIG. 3 is a block diagram illustrating one example of an electrical configuration of the copying machine of the embodiment.
Figure 4:
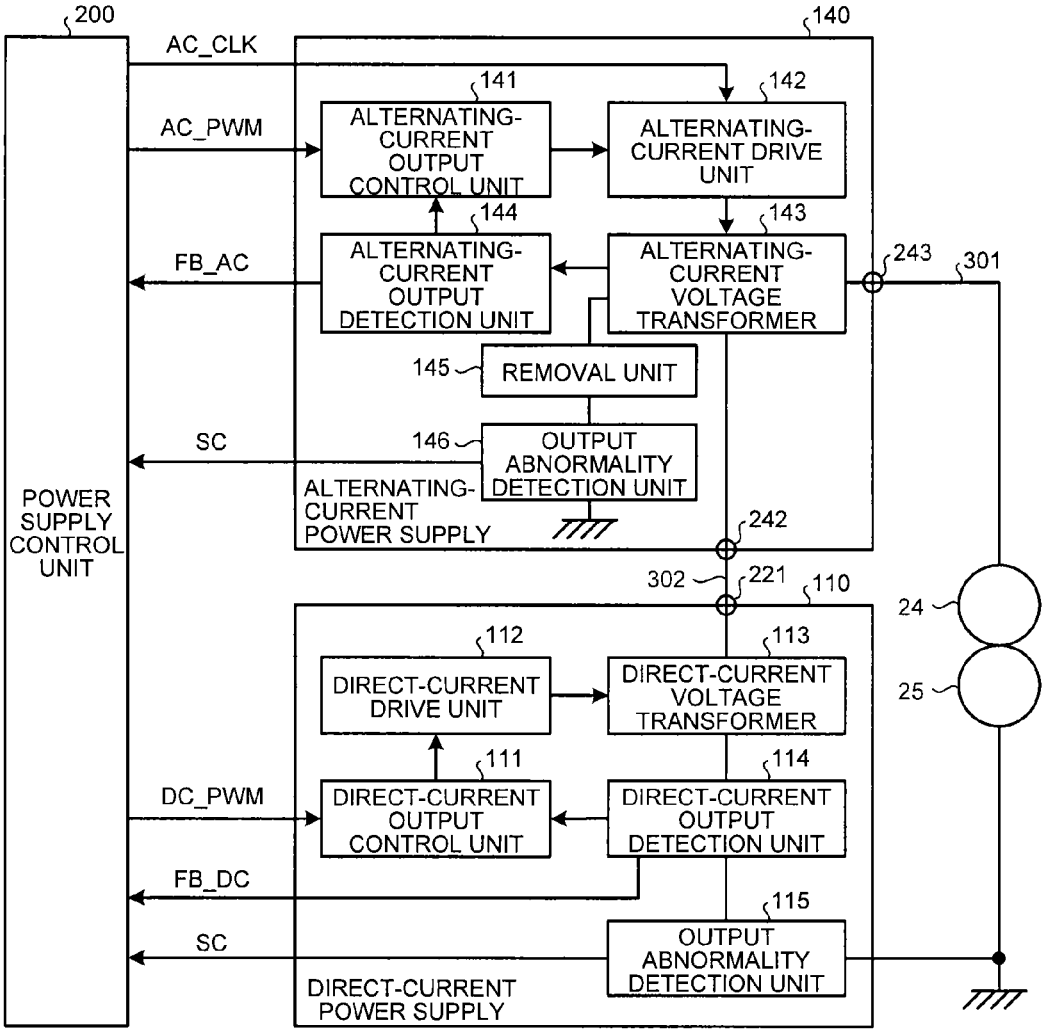
FIG. 4 is a block diagram illustrating one example of an electrical configuration of the copying machine of the embodiment.

FIGS. 3 and 4 are block diagrams illustrating examples of an electric configuration of the copying machine 2 of the embodiment. FIG. 3 illustrates an electric configuration with no connection of the alternating-current power supply 140, and FIG. 4 illustrates an electric configuration with connection of the alternating-current power supply 140. As illustrated in FIGS. 3 and 4, the copying machine 2 includes the direct-current power supply 110, the detachable alternating-current power supply 140, and a power supply control unit 200.

The direct-current power supply 110 is a power supply for toner transfer. The direct-current power supply 110 has a direct-current output control unit 111; a direct-current drive unit 112; a direct-current voltage transformer 113; a direct-current output detection unit 114; an output abnormality detection unit 115; and an electrical connector 221 (one example of a first electric connection unit). The alternating-current power supply 140 is a power supply for toner vibration. The alternating-current power supply 140 has an alternating-current output control unit 141; an alternating-current drive unit 142; an alternating-current voltage transformer 143; an alternating-current output detection unit 144; a removal unit 145; an output abnormality detection unit 146; an electrical connector 242 (one example of a second electric connection unit); and an electrical connector 243 (one example of a third electric connection unit). The power supply control unit 200 controls the direct-current power supply 110 and the alternating-current power supply 140. The power supply control unit 200 can be implemented by a control device having a CPU (central processing unit), a ROM (read only memory), and a RAM (random access memory), and the like, for example.

The direct-current output control unit 111 receives input of a DC_PWM signal controlling magnitude of output of a direct-current voltage from the power supply control unit 200, and receives input of an output value of the direct-current voltage transformer 113 detected by the direct-current output detection unit 114 from the direct-current output detection unit 114. Then, the direct-current output control unit 111 controls driving of the direct-current voltage transformer 113 via the direct-current drive unit 112 such that the output value of the direct-current voltage transformer 113 becomes equal to the output value indicated by the DC_PWM signal, according to the duty ratio of the input DC_PWM signal and the output value of the direct-current voltage transformer 113.

The direct-current drive unit 112 drives the direct-current voltage transformer 113 under control of the direct-current output control unit 111.

The direct-current voltage transformer 113 is driven by the direct-current drive unit 112 to output a high-voltage negative direct current. When the alternating-current power supply 140 is not connected, the electrical connector 221 and the repulsive roller 24 are electrically connected via a harness 301, and thus the direct-current voltage transformer 113 outputs (applies) a direct-current voltage to the repulsive roller 24 via the harness 301. Meanwhile, when the alternating-current power supply 140 is connected, the electrical connector 221 and the electrical connector 242 are electrically connected via a harness 302, and thus the direct-current voltage transformer 113 outputs a direct-current voltage to the alternating-current power supply 140 via the harness 302.

The direct-current output detection unit 114 detects the output value of the direct-current high-voltage from the direct-current voltage transformer 113, and outputs the same to the direct-current output control unit 111. The direct-current output detection unit 114 also outputs the detected output value as a FB_DC signal (feedback signal) to the power supply control unit 200. This output is intended to cause the power supply control unit 200 to control the duty of the DC_PWM signal so as not to deteriorate a transfer property depending on environment or load.

In the embodiment, the alternating-current power supply 140 is detachable, and thus the impedance of an output path of the high-voltage output varies depending on the situation in which the alternating-current power supply 140 is connected or not connected. Accordingly, when the direct-current power supply 110 performs constant voltage control to output a direct-current voltage, the impedance of the output path varies according to the presence or absence of the alternating-current power supply 140 to change the ratio of partial pressure and further alter a high voltage to be applied to the repulsive roller 24. This brings about a change in transfer property according to the presence or absence of the alternating-current power supply 140.

Thus, in the embodiment, the direct-current power supply 110 performs constant current control to output a direct-current voltage and change the output voltage according to the presence or absence of the alternating-current power supply 140. Accordingly, even when the impedance of the output path changes, it is possible to keep constant the high voltage to be applied to the repulsive roller 24, and keep constant the transfer property regardless of the presence or absence of the alternating-current power supply 140. Further, it is possible to attach or detach the alternating-current power supply 140 without having to change the value of the DC_PWM signal.

As in the foregoing, in the embodiment, the direct-current power supply 110 is subjected to constant current control. Alternatively, the direct-current power supply 110 may be subjected to constant voltage control as far as the high voltage to be applied to the repulsive roller 24 can be kept constant by changing the value of the DC_PWM signal at attachment or detachment of the alternating-current power supply 140.

The output abnormality detection unit 115 is positioned on the output line of the direct-current power supply 110. Upon occurrence of an output abnormality due to a ground fault of an electrical line or the like, the output abnormality detection unit 115 outputs an SC signal indicative of an output abnormality such as a leak or the like to the power supply control unit 200. This allows the power supply control unit 200 to control the direct-current power supply 110 to stop output of a high voltage.

The alternating-current output control unit 141 receives input of an AC_PWM signal controlling the magnitude of an output of an alternating-current voltage from the power supply control unit 200, and receives input of the output value of the alternating-current voltage transformer 143 detected by the alternating-current output detection unit 144 from the alternating-current output detection unit 144. Then, the alternating-current output control unit 141 controls driving of the alternating-current voltage transformer 143 via the alternating-current drive unit 142 such that the output value of the alternating-current voltage transformer 143 becomes equal to the output value indicated by the AC_PWM signal, according to the duty ratio of the input AC_PWM signal and the output value of the alternating-current voltage transformer 143.

The alternating-current drive unit 142 receives input of an AC_CLK signal controlling the output frequency of an alternating-current voltage. Then, the alternating-current drive unit 142 drives the alternating-current voltage transformer 143 according to the control of the alternating-current output control unit 141 and the AC_CLK signal. The alternating-current drive unit 142 drives the alternating-current voltage transformer 143 according to the AC_CLK signal to control an output waveform generated by the alternating-current voltage transformer 143 at an arbitrary frequency indicated by the AC_CLK signal.

The alternating-current voltage transformer 143 is driven by the alternating-current drive unit 142 to generate an alternating-current voltage, and superimposes the generated alternating-current voltage on the direct-current high voltage output from the direct-current voltage transformer 113 to generate a superimposed voltage. When the alternating-current power supply 140 is connected, the electrical connector 243 and the repulsive roller 24 are electrically connected via the harness 301, and thus the alternating-current voltage transformer 143 outputs (applies) the generated superimposed voltage to the repulsive roller 24 via the harness 301. When generating no alternating-current voltage, the alternating-current voltage transformer 143 outputs (applies) the direct-current high voltage output from the direct-current voltage transformer 113 to the repulsive roller 24 via the harness 301. The voltage (superimposed voltage or direct-current voltage) output from the repulsive roller 24 is then returned to the direct-current power supply 110 via the secondary transfer roller 25.

The alternating-current output detection unit 144 detects the output value of the alternating-current voltage from the alternating-current voltage transformer 143, and outputs the same to the alternating-current output control unit 141. In addition, the alternating-current output detection unit 144 outputs the detected output value as an FB_AC signal (feedback signal) to the power supply control unit 200. The alternating-current output detection unit 144 also outputs the detected output value as a FB_AC signal (feedback signal) to the power supply control unit 200. This output is intended to cause the power supply control unit 200 to control the duty of the AC_PWM signal so as not to deteriorate a transfer property depending on environment or load.

In the embodiment, the alternating-current power supply 140 performs constant voltage control. However, the alternating-current power supply 140 is not limited to this but may be configured to perform constant current control.

The alternating-current voltage generated by the alternating-current voltage transformer 143 (alternating-current power supply 140) may be sine wave or rectangular wave. In the embodiment, the alternating-current voltage is short-pulse rectangular wave. This is because using the alternating-current voltage of short-pulse rectangular waveform can further contributes to improvement of image quality.

Figure 5:
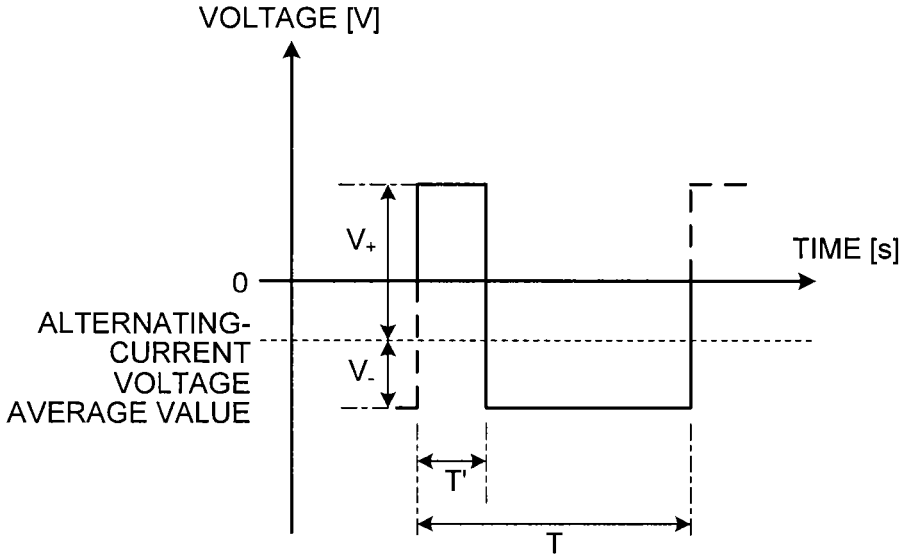
FIG. 5 is a diagram illustrating one example of a superimposed voltage formed by superimposing an alternating-current voltage of short-pulse rectangular wave form on a direct-current voltage.
Figure 6:
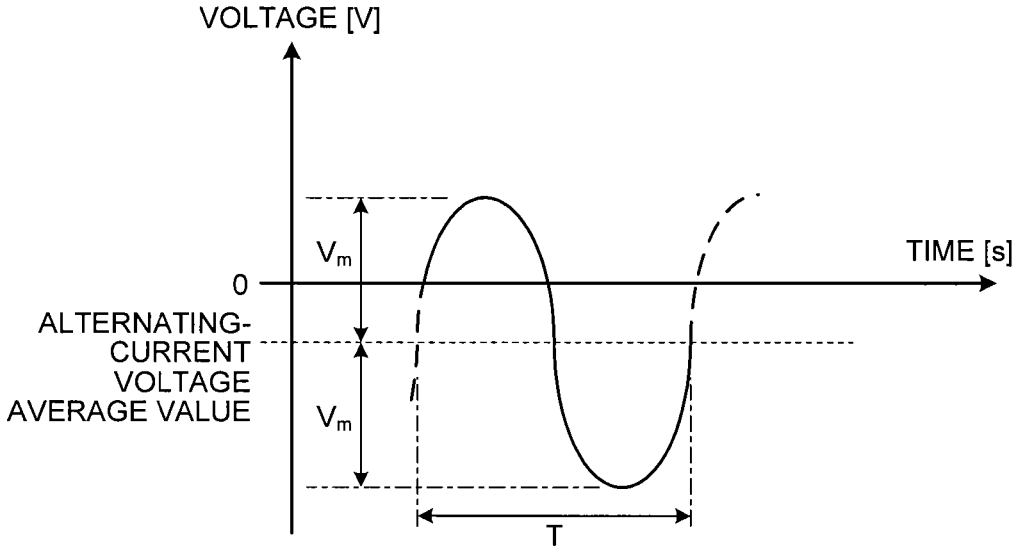
FIG. 6 is a diagram illustrating one example of a superimposed voltage formed by superimposing an alternating-current voltage of sine wave on a direct-current voltage.

Advantages of the short-pulse rectangular wave over the sine wave will be described below in detail. FIG. 5 is a diagram illustrating one example of a superimposed voltage formed by superimposing an alternating-current voltage of short-pulse rectangular waveform on a direct-current voltage, and FIG. 6 is a diagram illustrating one example of a superimposed voltage formed by superimposing an alternating-current voltage of sine wave on a direct-current voltage.

In general, an alternating-current voltage can be expressed by time. Thus, the superimposed voltage illustrated in FIG. 5 can be expressed by Equations (1) and (2), and the superimposed voltage illustrated in FIG. 6 can be expressed by Equation (3).

$$V(s)=V+(0\leq s\leq T') \quad (1)$$

$$V(s)=V-(T'\leq s\leq T) \quad (2)$$

$$V(s)=Vm \sin \omega s \quad (3)$$

In the foregoing equations, s denotes time, V+ the increased value of positive polarity of a pulse voltage, V− the increased value of negative polarity of the pulse voltage, T the cycle of waveform of the pulse voltage, and T' the switching point of polarity. In addition, the output energy of positive polarity and the output energy of negative polarity of the pulse voltage are equal, and thus the two has therebetween the relationship expressed in Equation (4) as follows:

$$V+\times T'=V-\times(T-T') \quad (4)$$

In addition, Vm denotes the amplitude of a sine wave, and ω the angular speed.

First, the superimposed voltages illustrated in FIGS. 5 and 6 are each formed by superimposing an alternating-current voltage on a negative direct-current voltage, and thus positive electrical energy and negative electrical energy are alternately applied on a periodic basis to the average value (negative value) of the superimposed voltage as value of the negative direct-current voltage. When the positive electrical energy is added on a periodic basis, the toner vibrates in the transfer direction and the opposite direction, and thus an increased amount of toner is attached to the indentations of the paper. Meanwhile, when the negative electrical energy is added on a periodic basis, the negative voltage increases and the negative voltage peak value is smaller than the average value of the superimposed voltage.

In this arrangement, when the negative voltage increases excessively, aerial discharge occurs and causes voids at indentations of the paper. Thus, the increased value of the negative voltage is preferably made smaller than the increased value of the positive voltage. However, as illustrated in FIG. 6, when the superimposed voltage is formed by superimposing an alternating-current voltage of sine wave on a direct-current voltage, the increased value of the voltage constitutes the amplitude Vm of the sine wave, which makes the foregoing adjustment difficult to make. Accordingly, in the embodiment, as illustrated in FIG. 5, the superimposed voltage is formed by superimposing an alternating-current voltage of short-pulse rectangular wave on a direct-current voltage, and the increased value V− of the negative voltage is made smaller than the increased value V+ of the positive voltage, thereby to prevent occurrence of voids at the indentations of the paper and achieve improvement of image quality.

In addition, when the positive peak value of the superimposed voltage illustrated in FIG. 5 and the positive peak value of the superimposed voltage illustrated in FIG. 6 are equal (V+=Vm), V− can be expressed by Equation (5) as follows:

$$V-=Vm\times T'/T-T' \quad (5)$$

In this arrangement, the inventor et al. have found out that image blurs are reduced when T' is about 10 to 20% of T. This is seemingly because, when a positive voltage of short-pulse rectangular waveform is applied for a shorter time, toner moves more abruptly as compared with the case of applying a positive voltage of sine wave, and thus dispersion of toner is reduced.

Accordingly, in the embodiment, as illustrated in FIG. 5, the superimposed voltage is formed by superimposing an alternating-current voltage of short-pulse rectangular wave on a direct-current voltage, and T' is set at about 10 to 20% of T, thereby to reduce blurs in images and achieve improvement of image quality.

Even when T' is set at about 10 to 20% of T, V− is kept at about 11 to 25% of Vm. This makes it possible to provide a margin of about Vm×¾ to Vm×⅘ with respect to an aerial discharge voltage, as compared to the superimposed voltage illustrated in FIG. 6, and prevent occurrence of voids at indentations of the paper resulting from aerial discharge.

Returning to FIG. 4, the removal unit 145 is configured to remove (bypass) a current flowing (sneaking) into the direct-current power supply 110 by application of the superimposed voltage by the alternating current power supply 140 to the repulsive roller 24. The removal unit 145 can be implemented by a bypass capacitor or the like, for example. This makes it possible to prevent sneaking of a current into the direct-current power supply 110 upon output of the alternating-current power supply 140, and suppress loss in the direct-current power supply 110.

However, at startup of the direct-current power supply 110, no electrical charge is accumulated in the bypass capacitor (removal unit 145), and thus the impedance of the bypass capacitor is excessively low and the direct current output from the direct-current power supply 110 flows into the bypass capacitor. Thus, the direct-current power supply 110 cannot supply sufficient electric power to the repulsive roller 24 until an electric charge is accumulated in the bypass capacitor, which leads to a delay in the starting time. Meanwhile, at stoppage of the direct-current power supply 110, an electrical charge is accumulated in the bypass capacitor even after driving of the direct-current drive unit 112 is stopped. Thus, the output of the direct-current voltage from the direct-current power supply 110 is not completely lowered until the electrical charge accumulated in the bypass capacitor is consumed, which leads to a delay in the falling time.

Accordingly, in the embodiment, the removal unit 145 (bypass capacitor) is provided in the detachable alternating-current power supply 140 to avoid occurrence of the foregoing problems when the alternating-current power supply 140 is not connected, thereby to improve the response speed of an applied voltage with no connection of the alternating-current power supply 140. Therefore, according to the embodiment, it is possible to shorten the power-on time and decrease the interval between paper feedings when the alternating-current power supply 140 is not connected, thereby achieving lower power consumption and improved printing speed.

The output abnormality detection unit 146, upon occurrence of an output abnormality due to a ground fault of an electrical line or the like, outputs an SC signal indicative of an output abnormality such as a leak to the power supply control unit 200. This allows the power supply control unit 200 to control the alternating-current power supply 140 to stop output of a high voltage from the alternating-current power supply 140.

Figures 7, 8:
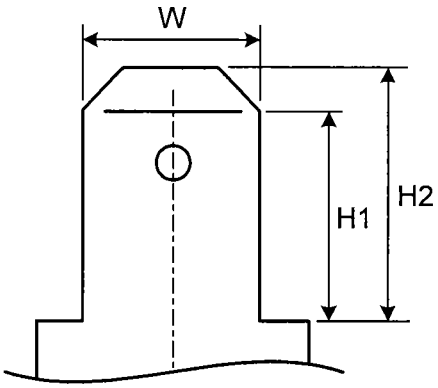
FIG. 7 is a diagram illustrating one example of shapes of electrical connectors of the embodiment.
FIG. 8 is a diagram indicating one example of dimensions (sizes) of the electrical connectors of the embodiment.
Figure 9:
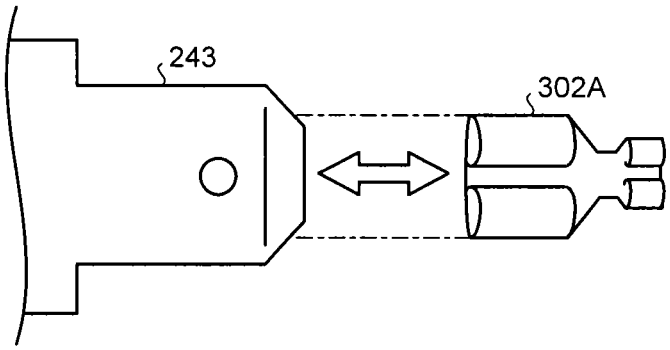
FIG. 9 is a diagram illustrating an example of prevention of improper connection with the electrical connector of the embodiment.

FIGS. 7 to 9 are illustrative diagrams of a method for preventing improper connections of electrical connectors 221, 242, and 243 of the embodiment. FIG. 7 is a diagram illustrating one example of shapes of the electrical connectors 221, 242, and 243 of the embodiment, and FIG. 8 is a diagram indicating one example of dimensions (sizes) of the electrical connectors 221, 242, and 243 of the embodiment, and FIG. 9 is a diagram illustrating an example of prevention of improper connection with the electrical connector 243 of the embodiment.

The electrical connectors 221, 242, and 243 of the embodiment can be implemented by output terminals such as tub terminals, for example, as illustrated in FIG. 7. If these connection units are improperly connected, the superimposed voltage output from the alternating-current power supply 140 interferes with the direct-current power supply 110 to disable output of a high voltage. Accordingly, in the embodiment, the electrical connector 242 and the electrical connector 243 are made different in size to prevent improper connection.

The direct-current power supply 110 and the alternating-current power supply 140 in the embodiment each output a high voltage, and thus the electrical connectors 221, 242, and 243 may be tub terminals of about #187 to #250 (see FIGS. 7 and 8). The electrical connector 242 and the electrical connector 243 are made different in size to prevent improper connection.

For example, it is assumed that the electrical connector 242 is formed as a tub terminal of #187 and the electrical connector 243 as a tub terminal of #250. This makes it possible to prevent situations in which, when the electrical connector 221 and the electrical connector 242 are to be connected via the harness 302, the electrical connector 221 and the electrical connector 243 are wrongly connected via the harness 302 or when the electrical connector 243 and the repulsive roller 24 are to be connected via the harness 301, the electrical connector 242 and the repulsive roller 24 are wrongly connected via the harness 301.

Specifically, as illustrated in FIG. 9, the harness 302 to be connected with the electrical connector 242 has an electrical connector (female contact of the tub terminal) 302A dedicated for a tub terminal of #187. Thus, when an attempt is made to connect the electrical connector 302A with the electrical connector 243 as a tub terminal of #250, the two connectors will not fit together, thereby preventing improper connection. Similarly, the harness 301 to be connected with the electrical connector 243 has an electrical connector (female contact of a tub terminal) dedicated for a tub terminal of #250. Thus, when an attempt is made to connect the electrical connector with the electrical connector 242 as a tub terminal of #187, the two connectors will not fit together, thereby preventing improper connection.

In addition, when the electrical connector 221 and the electrical connector 243 are made identical in size, it is possible to use the harness 301 in common for connecting the electrical connector 221 and the repulsive roller 24 when the alternating-current power supply 140 is not connected and for connecting the electrical connector 243 and the repulsive roller 24 when the alternating-current power supply 140 is connected, thereby achieving cost reduction. For example, in the foregoing example, the electrical connector 221 may be set as a tub terminal of #250.

Further, the harness 302 may have a length with which, with respect to the arrangement of the direct-current power supply 110 and the alternating-current power supply 140, the electrical connector 221 and the electrical connector 242 can be connected together but the electrical connector 221 and the electrical connector 243 cannot be connected together. In this case, it is also possible to prevent improper connection between the electrical connector 242 and the electrical connector 243.

In the embodiment, since the electrical connectors 221, 242, and 243 are made identical in shape, the electrical connector 242 and the electrical connector 243 are made different in size. Alternatively, the electrical connector 242 and the electrical connector 243 may be made different in shape.

Figure 10:
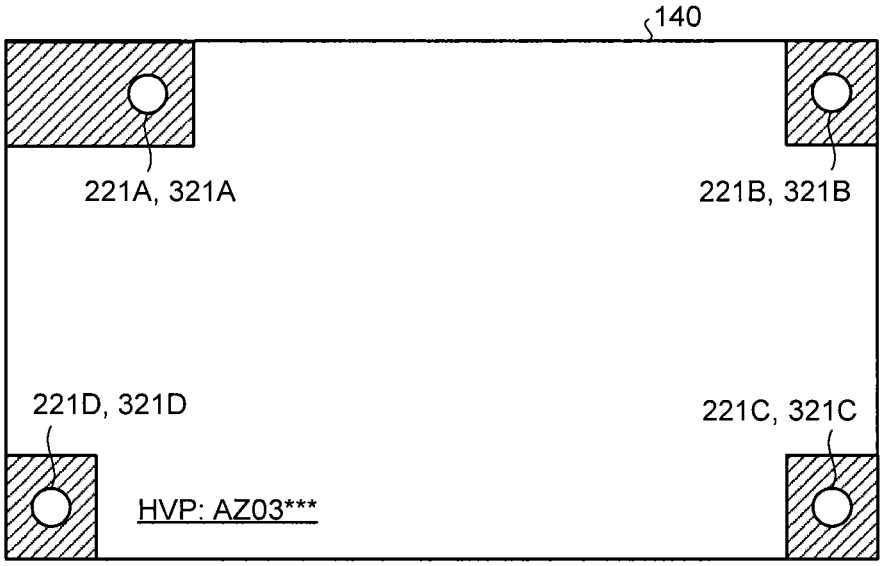
FIG. 10 is a diagram illustrating arrangement of an alternating-current power supply of the embodiment for correct attachment.
Figure 11:
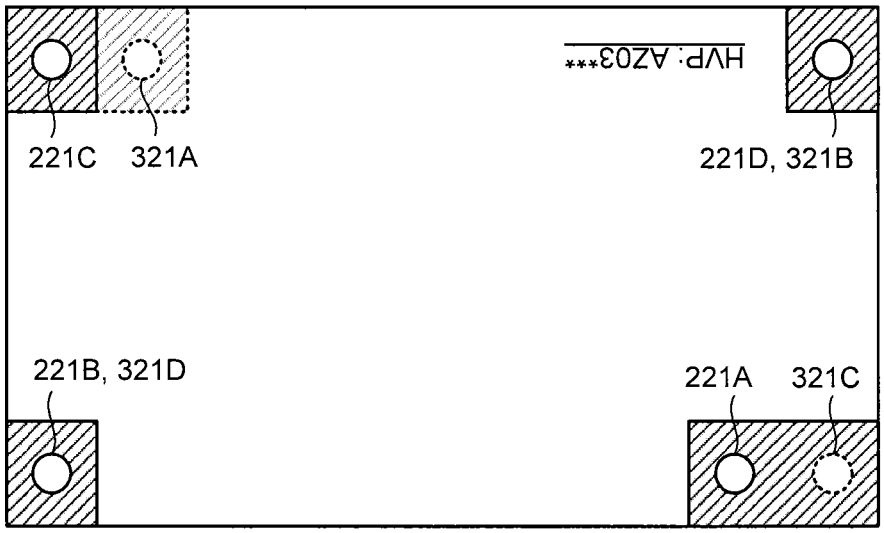
FIG. 11 is a diagram illustrating arrangement of the alternating-current power supply of the embodiment for incorrect attachment.

FIGS. 10 and 11 are illustrative diagrams of a method for preventing physical improper connection of the alternating-current power supply 140 of the embodiment.

FIG. 10 is a diagram illustrating arrangement of the alternating-current power supply 140 of the embodiment for correct attachment. FIG. 11 is a diagram illustrating arrangement of the alternating-current power supply 140 of the embodiment for incorrect attachment As illustrated in FIG. 10, the alternating-current power supply 140 of the embodiment has four screw holes 221A to 221D arranged asymmetrically about a point with respect to the center of the alternating-current power supply 140 as a plurality of physical connectors for making physical connections with the copying machine 2 (specifically, a substrate not illustrated). Screw holes 321A to 321D are screw holes on the substrate not illustrated into which the alternating-current power supply 140 is screwed.

As in the foregoing, in the embodiment, the four screw holes 221A and 221D are arranged asymmetrically about a point, and thus the screw holes 221A to 221D align with the screw holes 321A to 321D to enable the screwing of the alternating-current power supply 140 only when the alternating-current power supply 140 is correctly positioned with respect to the substrate into which the alternating-current power supply 140 is to be screwed. Meanwhile, as illustrated in FIG. 11, when the alternating-current power supply 140 is not correctly positioned with a rotation of 180 degrees with respect to the substrate into which the alternating-current power supply 140 is to be screwed, the screw holes 221B and 221D align with the screw holes 321D and 321B, respectively, but the screw holes 221A and 221C do not align with the screw holes 321A and 321C to disable the screwing.

Accordingly, it is possible to prevent the alternating-current power supply 140 from being physically connected in an improper position to the copying machine 2, which contributes to prevention of improper connections of the electrical connector 242 and the electrical connector 243.

Figure 12:
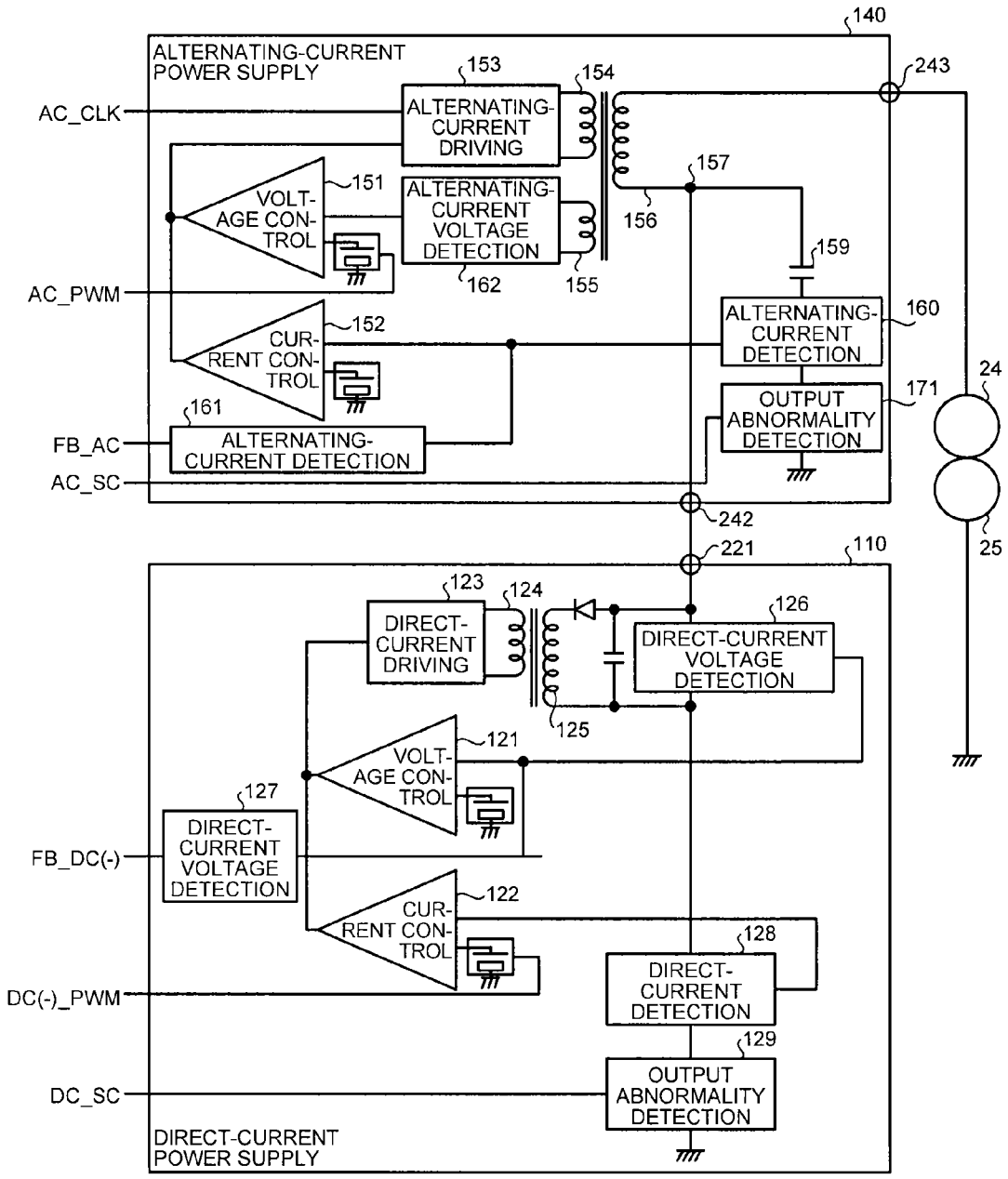
FIG. 12 is a circuit diagram illustrating one example of a configuration of a direct-current power supply and an alternating-current power supply of the embodiment.

FIG. 12 is a circuit diagram illustrating one example of a configuration of the direct-current power supply 110 and the alternating-current power supply 140 of the embodiment.

The direct-current power supply 110 receives input of a DC(−)_PWM signal from the power supply control unit 200, and integrates the input DC(−)_PWM signal and inputs the same into a current control circuit 122 (comparator). The value of the integrated DC(−)_PWM signal constitutes a reference voltage in the current control circuit 122. A direct-current detection circuit 128 detects the direct current output from the direct-current power supply 110 on the output line of the direct-current power supply 110, and inputs the output value of the detected direct current to the current control circuit 122. The current control circuit 122 drives positively a direct-current drive circuit 123 of a direct-current high-voltage transformer when the direct current is small with respect to the reference voltage, and controls driving of the direct-current drive circuit 123 of the direct-current high-voltage transformer when the direct current is large with respect to the reference voltage. This allows the direct-current power supply 110 to keep a constant current property.

In addition, a direct-current voltage detection circuit 126 detects the direct-current voltage output from the direct-current power supply 110, and inputs the output value of the detected direct-current voltage to a voltage control circuit 121 (comparator). When the output value of the direct-current voltage has reached the upper limit, the voltage control circuit 121 controls driving of the direct-current drive circuit 123 of the direct-current high-voltage transformer. A direct-current voltage detection circuit 127 feeds back the output value of the direct-current voltage detected by the direct-current voltage detection circuit 126 as an FB_DC(−) signal to the power supply control unit 200.

Output from a primary winding wire N1_DC(−) 124 of the direct-current high-voltage transformer and a secondary winding wire N2_DC(−) 125 of the direct-current high-voltage transformer generated by driving of the direct-current drive circuit 123 under control of the current control circuit 122 and the voltage control circuit 121, is smoothed out by a diode and a capacitor, and is input as a direct-current voltage from an alternating-current power supply input unit 157 into the alternating-current power supply 140 via the electrical connector 221 and the electrical connector 242, and then is applied to a secondary winding wire N2_AC 156 of an alternating-current high-voltage transformer. However, when the alternating-current power supply 140 is not connected, the output is output (applied) as a direct-current voltage to the repulsive roller 24 via the electrical connector 221 and the electrical connector 243.

An output abnormality detection circuit 129 monitors output from the direct-current power supply 110. When detecting that the output value has suddenly changed or no output is provided, the output abnormality detection circuit 129 outputs a DC_SC signal indicative of an output abnormality in the direct-current power supply 110 to the power supply control unit 200.

The alternating-current power supply 140 receives input of an AC_PWM signal from the power supply control unit 200 and inputs the same to a voltage control circuit 151 (comparator). The value of the input AC_PWM signal constitutes a reference voltage in the voltage control circuit 151. In addition, an alternating-current voltage detection circuit 162 predicts the output value of the alternating-current voltage from a mutual induction voltage generated by a primary winding wire N3_AC 155 of the alternating-current high-voltage transformer, and inputs the predicted output value of the alternating-current voltage to the voltage control circuit 151. This is because, since the alternating-current voltage is superimposed on the direct-current voltage, it is difficult to detect only the output (alternating-current voltage) of the alternating-current power supply 140 on the output line of the alternating-current power supply 140. The voltage control circuit 151 drives positively an alternating-current drive circuit 153 when the alternating-current voltage is small with respect to the reference voltage, and controls driving of the alternating-current drive circuit 153 of the alternating-current high-voltage transformer when the alternating-current voltage is large with respect to the reference voltage. This allows the alternating-current power supply 140 to keep a constant voltage property.

An alternating-current detection circuit 160 detects the alternating current at the lower-voltage side of a alternating bypassing capacitor 159 on the output line of the alternating-current power supply 140, and inputs the detected output value of the alternating current to a current control circuit 152 (comparator). When the output value of the alternating current has reached the upper limit, the current control circuit 152 controls driving of the alternating-current drive circuit 153 of the alternating-current high-voltage transformer. An alternating-current detection circuit 161 feeds back the detected output value of the alternating current as an FB_AC signal to the power supply control unit 200.

The alternating-current drive circuit 153 of the alternating-current high-voltage transformer is driven based on the logical AND of the AC_CLK signal input from the power supply control unit 200 and the voltage control circuit 151 and the current control circuit 152 to generate an output with the same cycle as that of AC_CLK.

Upon driving of the alternating-current drive circuit 153, the alternating-current voltage generated by a primary winding wire N1_AC 154 of the alternating-current high-voltage transformer is superimposed on the direct-current voltage applied to the secondary winding wire N2_AC 156, and is output (applied) as a superimposed voltage from the electrical connector 243 to the repulsive roller 24. However, when the alternating-current power supply 140 is not driven, the direct-current voltage applied to the secondary winding wire N2_AC 156 is output (applied) directly from the electrical connector 243 to the repulsive roller 24.

An output abnormality detection circuit 171 monitors output from the alternating-current power supply 140. When detecting that the output value has suddenly changed or no output is provided, the output abnormality detection circuit 171 outputs an AC_SC signal indicative of an output abnormality in the alternating-current power supply 140 to the power supply control unit 200.

As in the foregoing, in the embodiment, since the alternating-current power supply 140 is detachable from the copying machine 2, it is possible to provide a secondary transfer power supply formed by the direct-current power supply 110 to customers who do not need printing on paper with low surface smoothness, and provide a secondary transfer power supply formed by the direct-current power supply 110 and the alternating-current power supply 140 to customers who need printing on paper with low surface smoothness.

Thus, according to the embodiment, it is possible to provide an optimum secondary transfer power supply to achieve functionality needed by customers while suppressing increase in man-hour for development, management cost, and the like. In particular, according to the embodiment, the secondary transfer power supply can be formed by the direct-current power supply 110 to eliminate the problem that the standby power of the alternating-current power supply 140 and the direct-current voltage output from the direct-current power supply 110 are lost in the alternating-current power supply 140. In addition, according to the embodiment, the alternating-current power supply 140 is detachable from the copying machine 2, which makes it possible to support customers who first do not need printing on paper with low surface smoothness but later come to need printing on paper with low surface smoothness.

MODIFICATION EXAMPLES

The present invention is not limited to the foregoing embodiment but may be modified in various manners.

Modification Example 1

For example, in the foregoing embodiment, the direct-current power supply may include a power supply for cleaning.

In the copying machine 2 of the foregoing embodiment, the intermediate transfer belt 23 always rotates during printing operations, as in general image forming devices. Thus, when there is no paper between the repulsive roller 24 and the secondary transfer roller 25 (in the case of the interval between paper feedings), toner on the intermediate transfer belt 23 is attached to the secondary transfer roller 25 to soil the back surface of the paper to be printed next. In particular, when duplex printing is performed, the toner attached to the secondary transfer roller 25 soils the image surface (printed surface), thereby leading to deterioration in image quality.

Accordingly, in modification example 1, during the interval between paper feedings, a direct-current voltage opposite in polarity (positive) to the direct-current voltage during transfer is applied to the repulsive roller 24 to stick the toner to the intermediate transfer belt 23 and prevent soiling of the secondary transfer roller 25.

Figure 13:
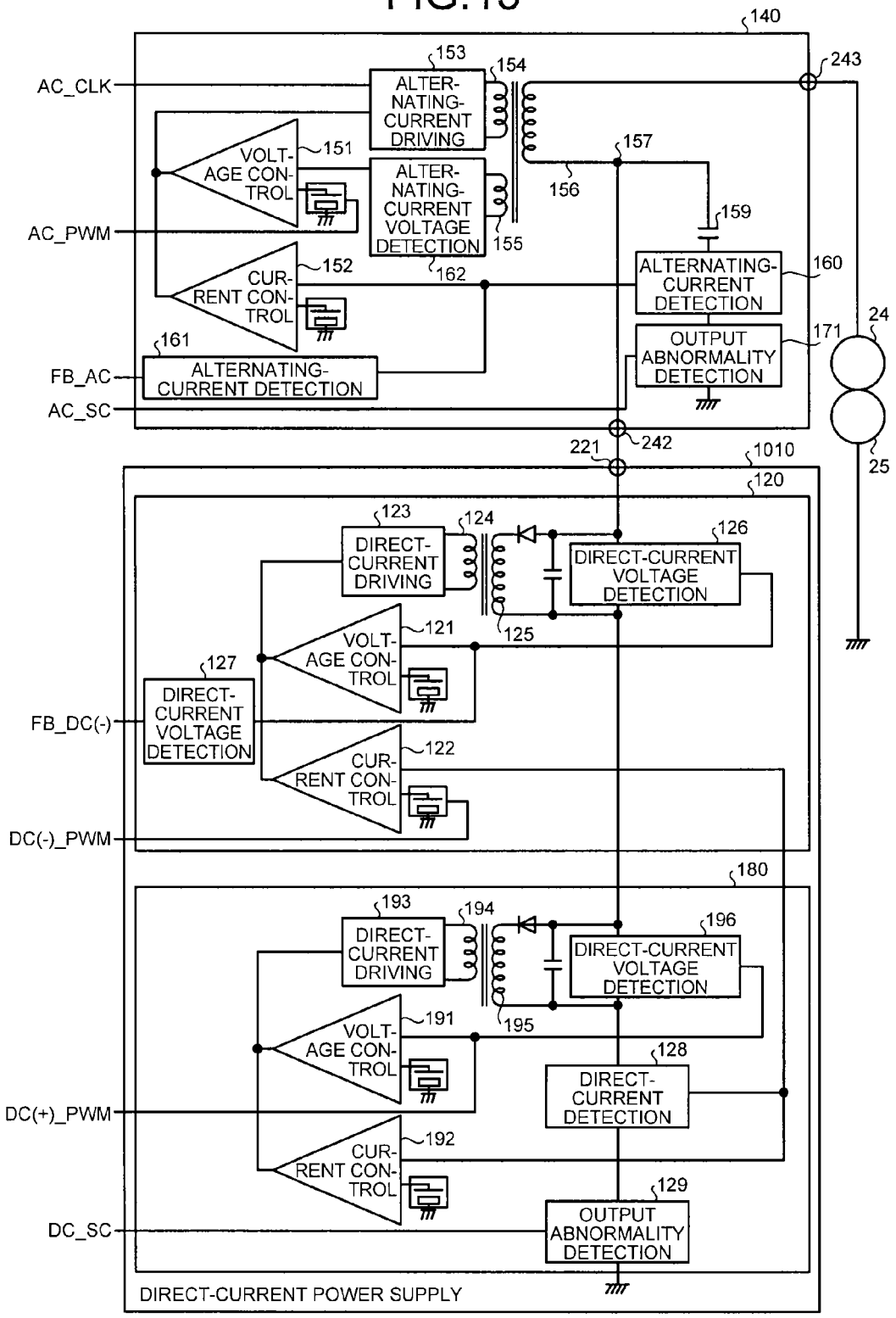
FIG. 13 is a circuit diagram illustrating one example of a configuration of a direct-current power supply and an alternating-current power supply of modification example 1.

FIG. 13 is a circuit diagram illustrating one example of a configuration of a direct-current power supply 1010 and the alternating-current power supply 140 of modification example 1. In modification example 1, the alternating-current power supply 140 is also detachable, and thus, besides a power supply for transfer 120 and a power supply for cleaning 180 are provided in the direct-current power supply 1010.

Operations of the direct-current power supply 1010 and the alternating-current power supply 140 during transfer of toner to the paper are the same as those in the foregoing embodiment, and thus descriptions thereof are omitted.

Meanwhile, during the interval between paper feedings, the power supply for cleaning 180 receives input of a DC(+)_PWM signal from the power supply control unit 200 into a voltage control circuit 191 (comparator). The value of the input DC(+)_PWM signal constitutes a reference voltage in the voltage control circuit 191. A direct-current voltage detection circuit 196 detects the direct-current voltage output from the power supply for cleaning 180 on the output line of the direct-current power supply 1010, and inputs the detected output value of the direct-current voltage to the voltage control circuit 191. The voltage control circuit 191 drives positively a direct-current drive circuit 193 of a direct-current high-voltage transformer when the direct-current voltage is small with respect to the reference voltage, and controls driving of the direct-current drive circuit 193 of the direct-current high-voltage transformer when the direct-current voltage is large with respect to the reference voltage. This allows the power supply for cleaning 180 to keep a constant voltage property.

In addition, the direct-current detection circuit 128 detects the direct current output from the power supply for cleaning 180, and inputs the detected output value of the direct current to a current control circuit 192 (comparator). When the output value of the direct current has reached the upper limit, the current control circuit 192 controls driving of the direct-current drive circuit 193 of the direct-current high-voltage transformer.

Output from a primary winding wire N1_DC(+) 194 of the direct-current high-voltage transformer and a secondary winding wire N2_DC(+) 195 of the direct-current high-voltage transformer generated by driving of the direct-current drive circuit 193 under control of the current control circuit 192 and the voltage control circuit 191, is smoothed out by a diode and a capacitor, and is input as a direct-current voltage from the alternating-current power supply input unit 157 into the alternating-current power supply 140, and then is applied to the secondary winding wire N2_AC 156 of the alternating-current high-voltage transformer. However, since the direct-current power supply 1010 and the alternating-current power supply 140 are not driven during the interval between paper feedings, the direct-current voltage applied to the secondary winding wire N2_AC 156 is output (applied) directly to the repulsive roller 24.

As in the foregoing, according to modification example 1, it is possible to prevent soiling of the paper by residual toner to achieve further improvement of image quality.

Modification Example 2

Figure 14:
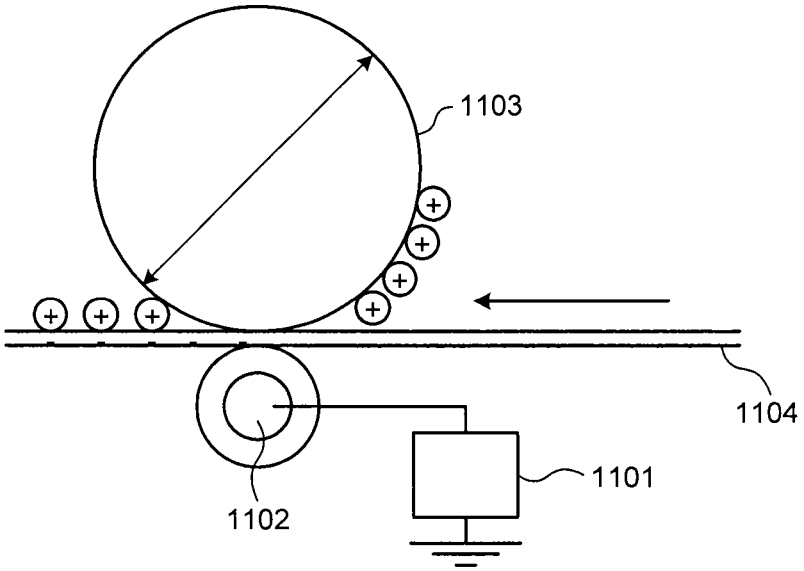
FIG. 14 is an illustrative diagram of modification example 2.

For example, in a configuration as illustrated in FIG. 14 in which a middle-resistive transfer roller 1102 is brought into contact with a photosensitive drum 1103, a power supply 1101 applies a bias to the transfer roller 1102, toner is transferred to paper 1104, and the paper 1104 is conveyed, a power supply configuration identical to that in the foregoing embodiment, specifically, a power supply configuration in which an alternating-current power supply is detachable, may be employed for the power supply 1101.

The image forming unit having the photosensitive drum 1103 and the like is configured in the same manner as in the foregoing embodiment. In the transfer roller 1102, a resistive layer made of conductive sponge is formed on a metallic core made of stainless steel, aluminum, or the like. In addition, a surface layer made of silicon resin or the like may be provided on the surface of the resistive layer.

The photosensitive drum 1103 and the transfer roller 1102 are in contact with each other to form a transfer nip (not illustrated). The photosensitive drum 1103 is grounded. The transfer roller 1102 is connected to the power supply 1101, and a transfer bias is applied to the transfer roller 1102. Accordingly, a transfer electric field is formed between the photosensitive drum 1103 and the transfer roller 1102 to move toner electrostatically from the photosensitive drum 1103 to the transfer roller 1102. A toner image on the photosensitive drum 1103 is transferred to the paper 1104 conveyed to the transfer nip by operations of the transfer electric field and nip pressure.

Modification Example 3

Figure 15:
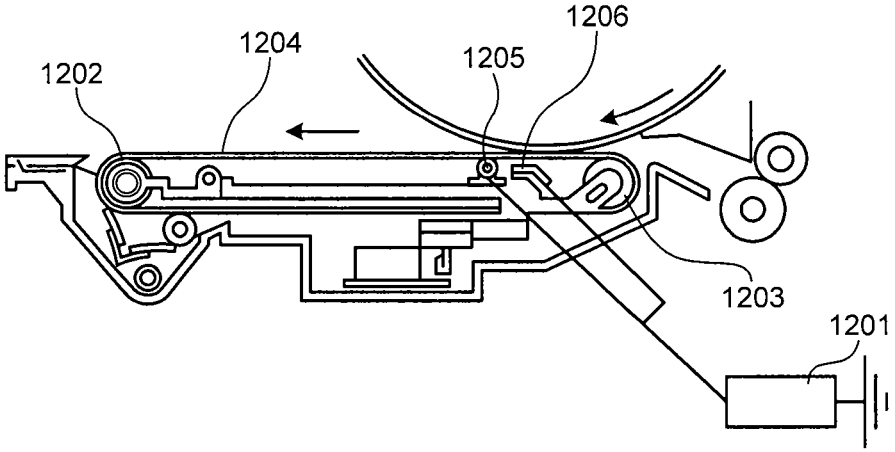
FIG. 15 is an illustrative diagram of modification example 3.

For example, in a configuration as illustrated in FIG. 15 in which a middle-resistive transfer belt 1204 is brought into contact with a photosensitive drum, a power supply 1201 applies a bias to the transfer belt 1204, toner is transferred to paper, and the paper is conveyed, a power supply configuration identical to that in the foregoing embodiment, specifically, a power supply configuration in which an alternating-current power supply is detachable, may be employed for the power supply 1201.

The image forming unit having the photosensitive drum and the like is configured in the same manner as in the foregoing embodiment. The transfer belt 1204 is spanned and supported between a driving roller 1202 and a driven roller 1203, and is run by the driving roller 1202 in the direction of arrow in the drawing. The transfer belt 1204 comes into contact with the photosensitive drum between the driving roller 1202 and the driven roller 1203. A transfer bias roller 1205 and a bias brush 1206 are provided inside the loop of the transfer belt 1204, and come into contact with the belt downstream of an area in which the photosensitive drum and the transfer belt 1204 contact each other.

The photosensitive drum and the transfer bias roller 1205 are in contact with each other to form a transfer nip (not illustrated). The photosensitive drum is grounded. The transfer bias roller 1205 is connected to the power supply 1201, and a transfer bias is applied to the transfer bias roller 1205. Accordingly, a transfer electric field is formed between the photosensitive drum and the transfer bias roller 1205 to move toner electrostatically from the photosensitive drum to the transfer bias roller 1205. A toner image on the photosensitive drum is transferred to the paper conveyed to the transfer nip by operations of the transfer electric field and nip pressure.

Either the transfer bias roller 1205 or the bias brush 1206 may be provided. In addition, either the transfer bias roller 1205 or the bias brush 1206 may be provided immediately under the transfer nip. Further, a transfer charger may be used instead of the transfer bias roller 1205 and the bias brush 1206.

Modification Example 4

Figure 16:
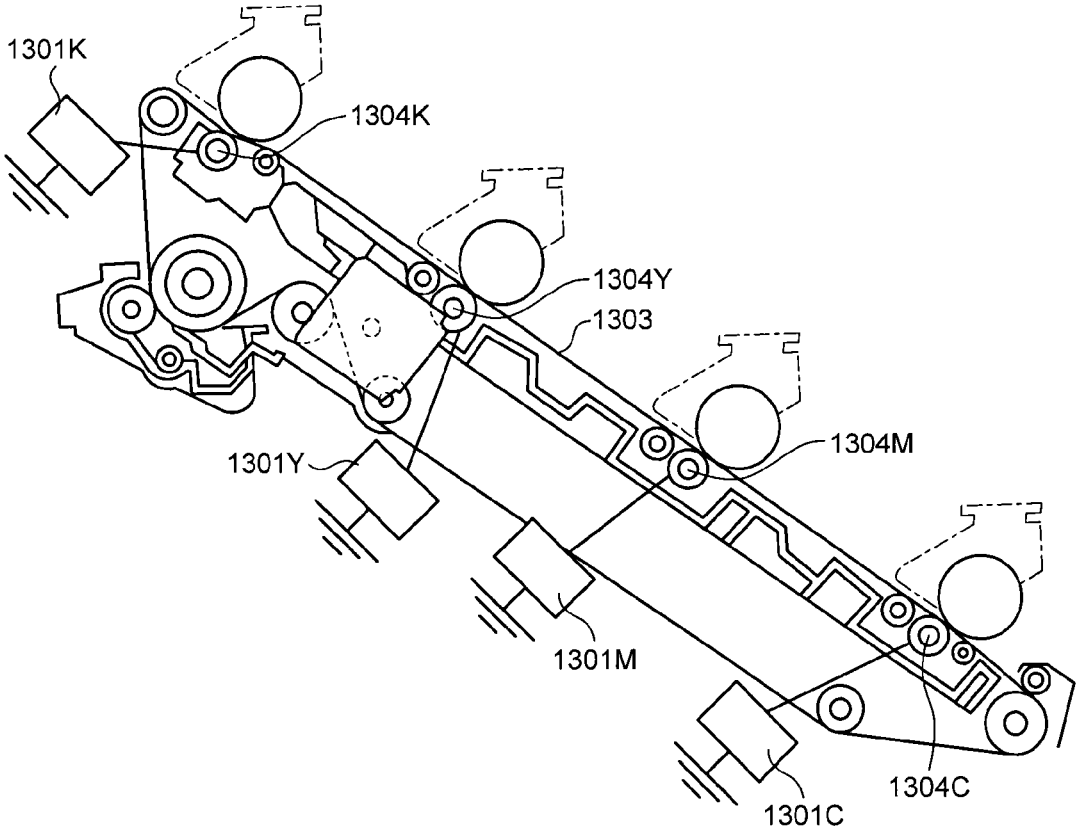
FIG. 16 is an illustrative diagram of modification example 4.

For example, in a configuration as illustrated in FIG. 16 in which transfer rollers of CMYK colors 1304C, 1304M, 1304Y, and 1304K are brought into contact with photosensitive drums of CMYK colors, respectively, via a middle-resistive transfer belt 1303, power supplies 1301C, 1301M, 1301Y, and 1301K apply a bias to the transfer rollers 1304C, 1304M, 1304Y, and 1304K, respectively, to transfer toner to paper, and the paper is transferred, a power supply configuration identical to that in the foregoing embodiment, specifically, a power supply configuration in which an alternating-current power supply is detachable, may be employed for the power supplies 1301C, 1301M, 1301Y, and 1301K.

The image forming units of respective colors having the photosensitive drums of CMYK colors and the like are configured in the same manner as in the foregoing embodiment, except that the colors of toner are different.

The transfer belt 1303 is spanned and supported between a plurality of rollers, and is run counterclockwise in the drawing. The transfer belt 1303 comes into contact with the photosensitive drums of respective colors. The transfer rollers of respective colors 1304C, 1304M, 1304Y, and 1304K are provided inside the loop of the transfer belt 1303, and are brought into contact with the transfer belt 1303 so as to be opposed to the photosensitive drums of respective colors.

The transfer roller 1304C and the photosensitive drum of C color are in contact with each other to form a transfer nip. The photosensitive drum of C color is grounded. The transfer roller 1304C is connected with the power supply 1301C, and a transfer bias is applied to the transfer roller 1304C. Accordingly, a transfer electric field is formed in the transfer nip to move toner of C color electrostatically from the photosensitive drum of C color to the transfer roller 1304C. The same operations are carried out on the photosensitive drums of the other colors, the transfer rollers of the other colors, and the power supplies of the other colors.

The paper is conveyed from the lower right side in the drawing. The paper is suctioned onto the transfer belt 1303 when passing between a paper suction roller and the transfer belt 1303, and then is conveyed to the transfer nips of respective colors. Toner images of respective colors on the photosensitive drums are sequentially transferred to the paper conveyed to the transfer nips by operations of the transfer electric fields and nip pressures, and then a full-color toner image is formed on the paper.

Instead of preparing the power supplies of respective colors 1301C, 1301M, 1301Y, and 1301K, one power supply may be used to apply a bias to the transfer rollers 1304C, 1304M, 1304Y, and 1304K.

Modification Example 5

Figure 17:
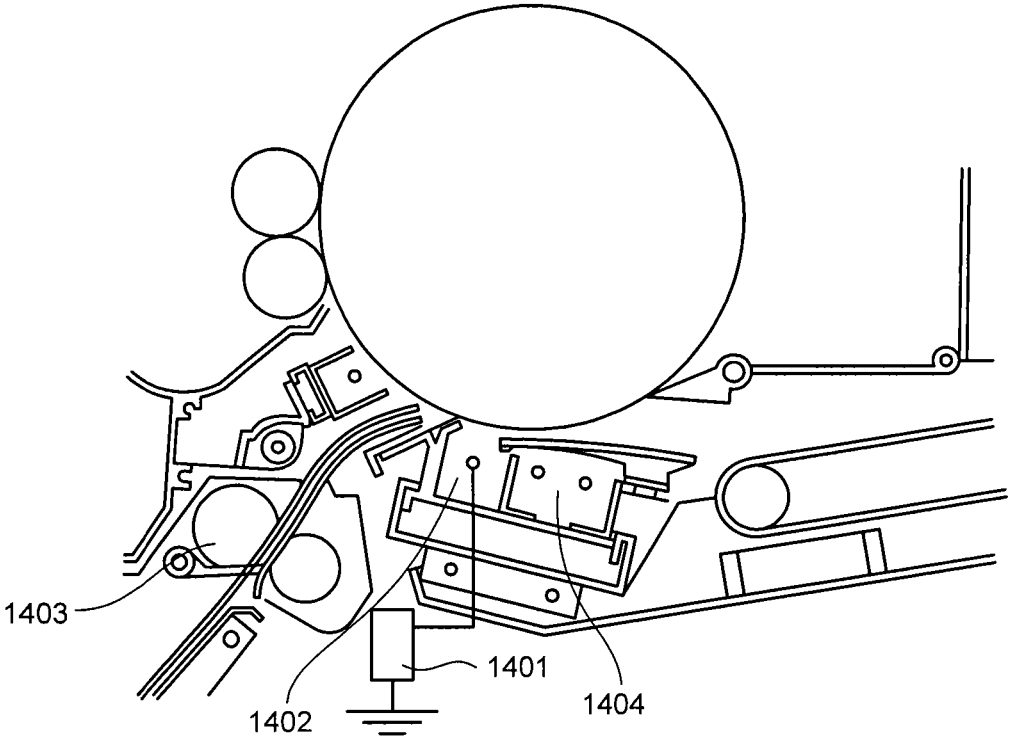
FIG. 17 is an illustrative diagram of modification example 5.

For example, in a system as illustrated in FIG. 17 in which a transfer charger 1402 and a separation charger 1404 are arranged near a photosensitive drum to transfer toner to paper and convey the paper in a separated state, a power supply configuration identical to that in the foregoing embodiment, specifically, a power supply configuration in which an alternating-current power supply is detachable, may be employed for an alternating-current power supply 1401 in the case where the alternating-current power supply 1401 applies a bias to a wire of the transfer charger 1402 to transfer toner to the paper and convey the paper.

Toner is transferred by the transfer charger 1402 to the paper after having passed through a resist roller 1403, and the paper is separated by the separation charger 1404 and then conveyed to a fixing unit.

Modification Example 6

Figure 18:
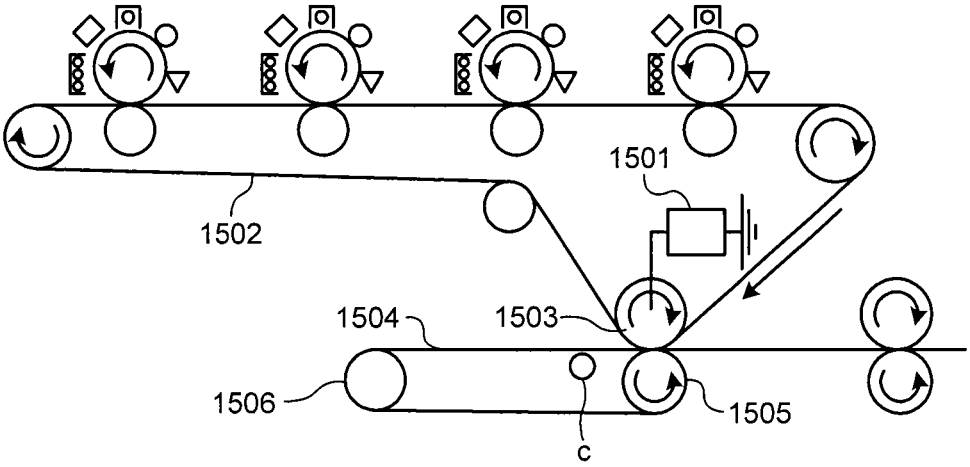
FIG. 18 is an illustrative diagram of modification example 6.

For example, in a system as illustrated in FIG. 18 in which a secondary transfer belt 1504 is brought into contact with an intermediate transfer belt 1502 to transfer toner to paper and convey the paper in a separated state, a power supply configuration identical to that in the foregoing embodiment, specifically, a power supply configuration in which an alternating-current power supply is detachable, may be employed for a power supply 1501 in the case where the power supply 1501 applies a bias to an opposed roller 1503 to transfer toner to the paper and convey the paper.

The image forming units of respective colors having the photosensitive drums of CMYK colors and the like are configured in the same manner as in the foregoing embodiment, except that the colors of toner are different.

The secondary transfer belt 1504 is spanned and supported between a driving roller 1505 and a driven roller 1506, and is run by the driving roller 1505 counterclockwise in the drawing. The secondary transfer belt 1504 comes into contact with the intermediate transfer belt 1502.

The secondary transfer belt 1504 and the intermediate transfer belt 1502 are in contact with each other to form a secondary transfer nip. The driving roller 1505 is grounded. The opposed roller 1503 is connected with the power supply 1501, and a transfer bias is applied to the opposed roller 1503. Accordingly, a transfer electric field is formed in the secondary transfer nip to move toner electrostatistically from the intermediate transfer belt 1502 to the secondary transfer belt 1504. A toner image on the intermediate transfer belt 1502 is transferred to the paper having entered into the secondary transfer nip by operations of the secondary transfer electric field and nip pressure.

Alternatively, the opposed roller 1503 may also be grounded, and a roller c may be provided to connect with the power supply 1501 to apply a transfer bias.

Modification Example 7

In the foregoing embodiment and modification examples, toner is negatively charged, and thus the transfer power supply applies a negative high voltage to the repulsive roller 24 to add a repulsive force to the toner for transfer. However, the present invention is not limited to this. For example, the secondary transfer power supply may apply a positive high voltage to the secondary transfer roller 25 to add an attraction force to the toner for transfer.

Modification Example 8

The foregoing embodiment and modification examples constitute mere examples of the present invention. It has been confirmed that the present invention can be realized with other configurations or under process conditions, using other image forming devices in various image forming environments.

According to the present invention, it is possible to advantageously provide an optimum power supply to achieve functionality needed by customers.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

a load including a transferring unit, the transferring unit being configured to transfer an image on a transferable material;

a direct current source connected to the load and configured to apply a direct voltage to the load; and an alternating current source connected between the load and the direct current source in an attachable and detachable manner, the alternating current source being configured to selectively apply to the load an overlapping voltage that is formed by overlapping an alternating voltage and the direct voltage.

2. The transfer device set forth in claim 1, wherein the direct current source includes a first electrical connector for making an electrical connection, the alternating current source includes a second electrical connector and a third electrical connector for making electrical connections, when the alternating current source is not connected to the load and the direct current source, the load is connected to the first electrical connector, and when the alternating current source is connected to the load and the direct current source, the first electrical connector and the second electrical connector are connected to each other, and the load is connected to the third electrical connector.

3. The transfer device set forth in claim 2, wherein the second electrical connector and the third electrical connector are different in at least one of shape and size.

4. The transfer device set forth in claim 3, wherein the first electrical connector and the third electrical connector are identical in shape and size.

5. The transfer device set forth in claim 1, wherein the alternating current source includes a plurality of physical connectors for connecting to the load, and the plurality of physical connectors are point-asymmetrically arranged.

6. The transfer device set forth in claim 1, wherein the direct current source controls a current at a constant level to output the direct voltage.

7. The transfer device set forth in claim 1, wherein the alternating current source includes a removal unit configured to remove an electric charge of the overlapping voltage that is not applied to the load.

8. The transfer device set forth in claim 1, wherein the alternating current source includes at least an alternating voltage transformer, an alternating driver configured to drive the alternating voltage transformer, and an alternating output controller configured to control the alternating driver.

9. The transfer device set forth in claim 1, wherein the alternating current source selectively outputs the direct voltage from the direct current source or the overlapping voltage.

10. A method for performing transfer, using the transfer device set forth in claim 1, the method comprising:

by the transferring unit, transferring the image on the transferable material;

by the direct current source, applying the direct voltage to the load; and by the alternating current source, selectively applying to the load the overlapping voltage that is formed by overlapping the alternating voltage and the direct voltage.

11. An image forming device comprising the transfer device set forth in claim 1.

12. The transfer device set forth in claim 1, wherein the alternating current source includes a bypass capacitor configured to charge an electric charge of the overlapping voltage that is not applied to the load.

13. The transfer device set forth in claim 1, wherein the transfer device transfers an image onto a sheet of paper being conveyed, and the load is a roller of the transfer device.

* * * * *